United States Patent [19]

Lavagetto

[11] 4,067,248

[45] Jan. 10, 1978

[54] CABLE ROTATOR

[76] Inventor: Lawrence J. Lavagetto, 815 1st West St., No. 28, Sonoma, Calif.

[21] Appl. No.: 712,822

[22] Filed: Aug. 9, 1976

[51] Int. Cl.[2] ..... F16C 1/16

[52] U.S. Cl. ..... 74/501 R; 64/2 R; 15/104.3 SN

[58] Field of Search ..... 74/501 R; 64/2; 15/104.3 SN

[56] References Cited

U.S. PATENT DOCUMENTS

| | | | |
|---|---|---|---|
| 2,111,527 | 3/1938 | Blanc | 15/104.3 SN |
| 2,267,493 | 12/1941 | Clotz | 15/104.3 SN |
| 2,318,172 | 5/1943 | Long | 15/104.3 SN |
| 2,685,097 | 8/1954 | Allen | 15/104.3 SN |
| 2,769,191 | 11/1956 | Hunt | 15/104.3 SN |

*Primary Examiner*—Clarence R. Gordon
*Attorney, Agent, or Firm*—Bielen and Peterson

[57] ABSTRACT

A cable rotator utilizing a hollow member having a pair of spaced openings communicating with its interior. A collar, having a first and second opening, permits passage of the hollow member through the first opening. The hollow member frictionally engages the sides of the collar's first opening, with a certain degree of slippage. The cable passes through the interior of the hollow member with a portion of the cable disposed to the exterior of the hollow member via the hollow member's openings and the second opening of the collar. Means for rotating the collar also rotates the hollow member, restraining rotation of the hollow member causes rotation of the cable.

10 Claims, 9 Drawing Figures

CABLE ROTATOR

BACKGROUND OF THE INVENTION

The present invention relates to a novel cable rotator.

Passageways have been employed since early recorded times to conduit flowable materials from one location to another. The problem of clogged passageways has plagued conduit systems from their inception. The clogging usually occurs largely because of the lodging of solid materials in a lateral section of the particular conduit.

Among the previously known methods of freeing clogged conduits, is the technique of rotating a flexible cable or "snake", particularly useful in unclogging a toilet. The existing cable rotators employ bulky drive mechanisms utilizing complicated gearing. These devices are difficult and expensive to work, requiring skilled personnel for maintenance and operation.

There is a need for a simple and facile cable rotator especially useful in cleaning stoppered conduits.

SUMMARY OF THE INVENTION

In accordance with the present invention a novel cable rotator is provided. The device includes a hollow elongated member having a pair of spaced openings or slots disposed in its wall.

The hollow elongated member passes through the first opening in a collar such that one of the slots lies on either side of the collar. The hollow elongated member frictionally and slippingly engages the sides of the collar's first opening. A cable passes through the interior of the hollow member, a portion of the cable passing out of one of the slots, through a second opening in the collar and back into the hollow elongated member's interior through the other slot.

Means for rotating the collar and the hollow member is included. Restraining the hollow elongated member against rotation causes slippage between the exterior wall of the hollow member and the sides of the first opening in the collar. Such rotational restraint on the elongated hollow member causes the cable to frictionally bear on the sides of the second opening in the collar, thus rotating the cable. Placement of a bit on the end of the rotating cable permits its employment as a conduit reamer, drill and the like. Release of the rotational restraint on the elongated hollow member stops the rotation of the cable.

The collar may take the form of a first wheel and the rotating means may include a second wheel, the periphery of said first and second wheels frictionally engaging one another. Thus, the second wheel rotates the first wheel. The rotational motion source for rotating the second wheel may be an electric drill and the invention may be deemed to include an adaptor for mounting the hollow elongated member, collar, and cable to the means for rotating the collar.

The cable rotator may additionally include restraining means for restraining rotation of the hollow elongated member relative to rotation of the first wheel. In one configuration such restraining means may be a drum circumjacently fixed about the exterior of a portion of the elongated hollow member relative to rotation of the first wheel. An open band positions about the exterior of the drums. Means for tightening the band about the exterior of the drum causes restraint in the rotation of the hollow elongated member and subsequent rotation of the cable.

The cable rotator structure may further embrace a housing for enclosing the collar and the cable portion exterior to the hollow member. A reel structure coils a protective sheath containing an end of the cable opposite to the working end of the cable. The sheath may mount to the housing and detach for convenience.

Thus, a novel and useful cable rotator is provided for the purposes stated and implied.

It is therefore an object of the present invention to provide a novel and inexpensive cable rotator useful for reaming and cleaning conduits and drilling openings.

It is another object of the present invention to provide a cable rotator suitable for cleaning clogged toilet drains.

It is yet another object of the present invention to provide a cable rotator adaptable for workability in cooperation with an electric drill mechanism.

Yet another object of the present invention is to provide a cable rotator safely enclosing that portion of the rotating cable not employed in cleaning, drilling and other such uses.

Another object of the present invention is to provide a hand-held cable rotator workable with normal pressure exerted by the human hand.

Another object of the present invention is to provide a cable rotator having a detachable portions for application of a cleaning force within a restricted work area.

The invention possesses other objects and advantages especially as concerns particular features and characteristics thereof which will become apparent as the specification continues.

Various aspects of the present invention will evolve from the following detailed description of the preferred embodiments thereof which should be taken in conjunction with the accompanying drawings.

For a better understanding of the invention, reference is made to the following detailed description.

DETAILED DESCRIPTION OF THE PREFERRED EMBODIMENTS

Figure 1:
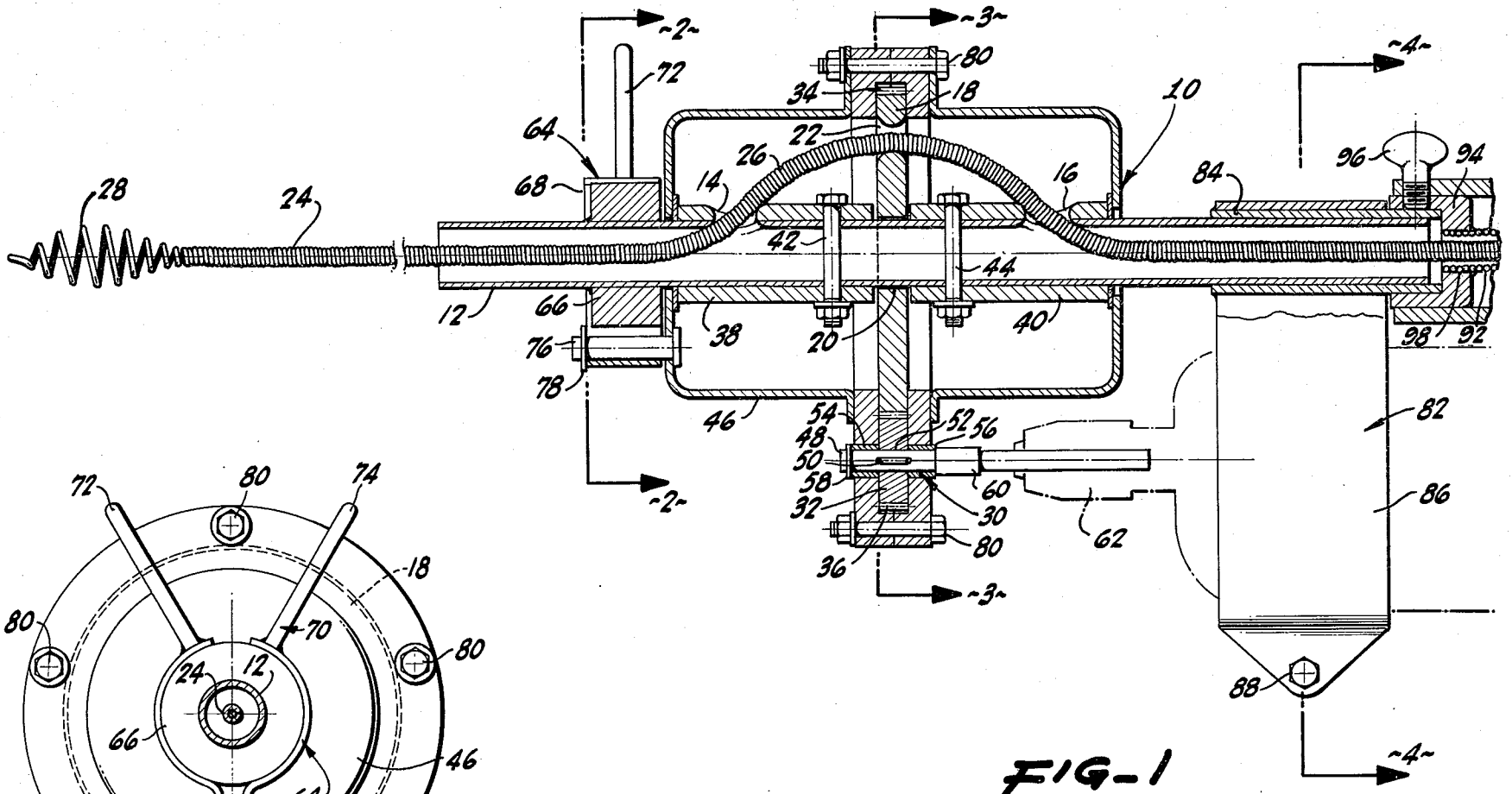
FIG. 1 is partially broken sectional view of the invention.

The invention as a whole is depicted in the drawings by reference character 10 and includes as one of its elements a hollow elongated member 12 having a pair of spaced openings or slots 14 and 16, FIG. 1, disposed in its wall. The slots 14 and 16 communicate with the interior of hollow elongated member 12. The member 12 may be fairly rigid in construction, using mateials such as wood, metal, plastic and the like.

A collar 18, in the form of a first wheel, provides a first opening 20 and a second opening 22 therethrough. Hollow elongated member 12 passes through first opening 20 and frictionally lippingly engages the sides of first opening 20. Thus rotation of collar 18, rotates elongated hollow member unless member 12 is restrained against rotation, in which case, slippage occurs between member 12 and the walls of opening 20. Split bushings 38 and 40, assembled by fastener 42 and 44, surround member 12 within housing 46.

Flexible cable 24 passes through the interior of hollow member 12. A portion 26 of cable 24 lies exterior thereto; cable 24 passing through slot 14, opening 22 and slot 16. Cable 24 is movable along the axis of member 12 in either direction, slot 14, opening 22 and slot 16 allowing such movement.

Figure 5:
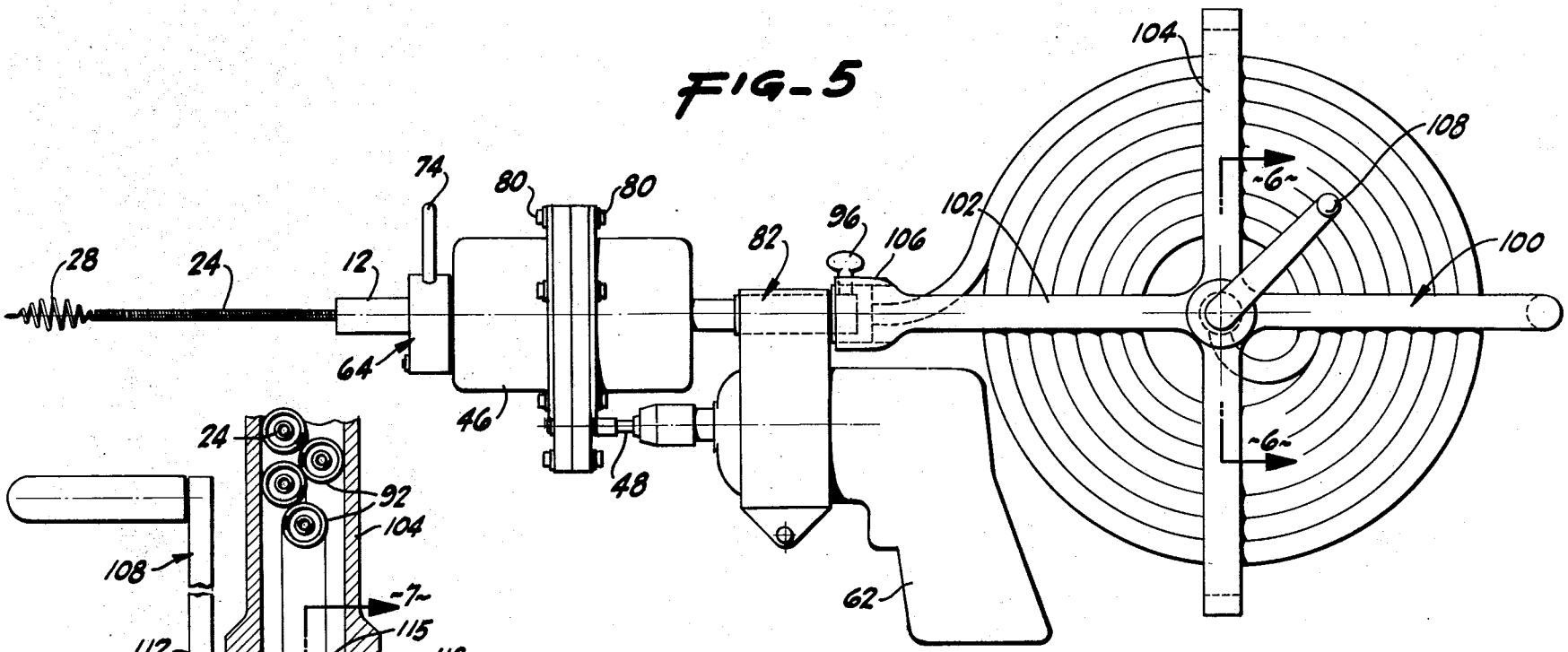
FIG. 5 is side elevational view of the invention.

Cable 24 may include an end portion 28 for drilling, cleaning and the like. As depicted in FIGS. 1 and 5, cable 24 has an end portion for freeing clogged pipes and drains.

Figure 3:
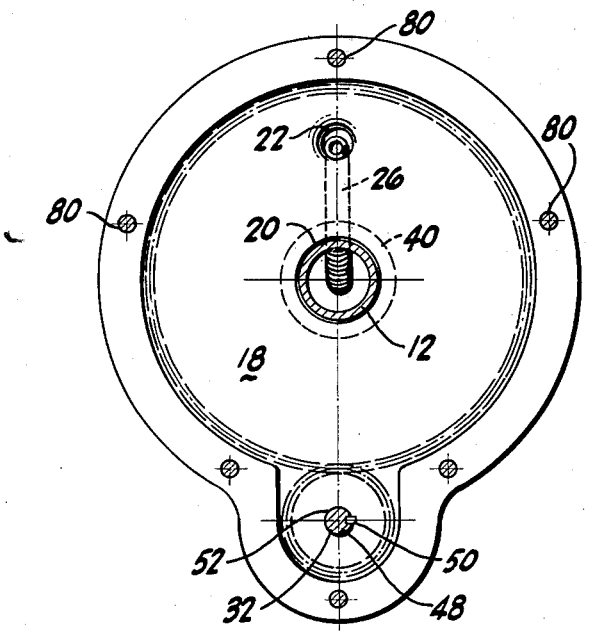
FIG. 3 is a view taken along line 3—3 of FIG. 1

The cable rotator 10 also includes as one of its elements rotating means 30 for rotating collar 18. Rotating means 30 includes a driving or second wheel 32. The peripheries of collar or first wheel 18 and second wheel 32 frictionally engage one another, FIGS. 1 and 3. As depicted in the drawings, collar 18 and driving wheel 32 have teeth 34 and 36 which intermesh. Shaft 48 having key 50 passes through and fixes to center opening 52 of driving wheel 32. Bearings 54 and 56, washer 58 and bushing 60 are circumferentially disposed in relation to shaft 48. Rotational motion source 62 may be an electric drill mechanism well known in the prior art.

Figure 2:
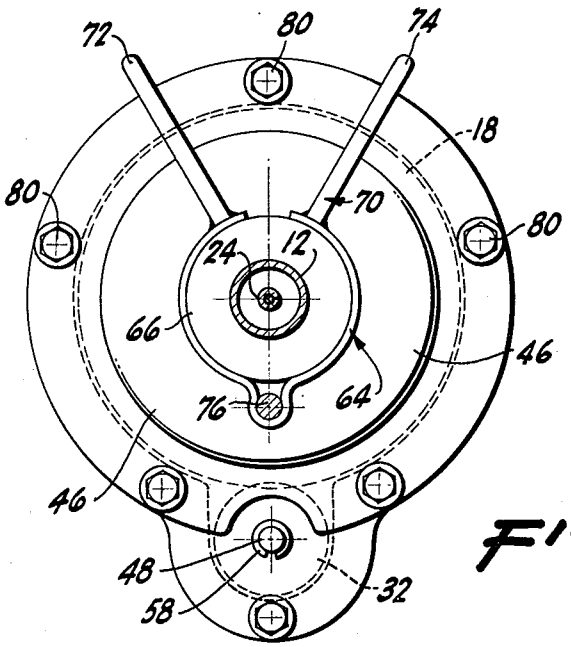
FIG. 2 is a view — taken along line 2—2 of FIG. 1

An embodiment of the cable rotator 10 may have restraining means 64, FIGS. 1 and 2, which may include a drum 66 circumjacently affixed to a portion of member 12. An open band 68 positions about the exterior of drum 66. Means 70 for tightening band 68 may externalize in a pair of arms 72 and 74 connected to the end portions of open band 68. Lug 76 having flange 78, forming a guide for band 68, connects to housing 46.

Fasteners 80 removably hold housing 46 (which has a symmetrically split construction) about collar 18, driving wheel 32, and cable portion 26 exterior to member 12, as well as a portion of member 12 surrounded by bushings 38 and 40. Thus the moving parts of cable rotator 10 are isolated from the external environment. This feautre reduces noise and clogging by particulate matter. Also, housing 46 provides safety to the user of invention 10, FIGS. 1, 3 and 5.

Figure 4:
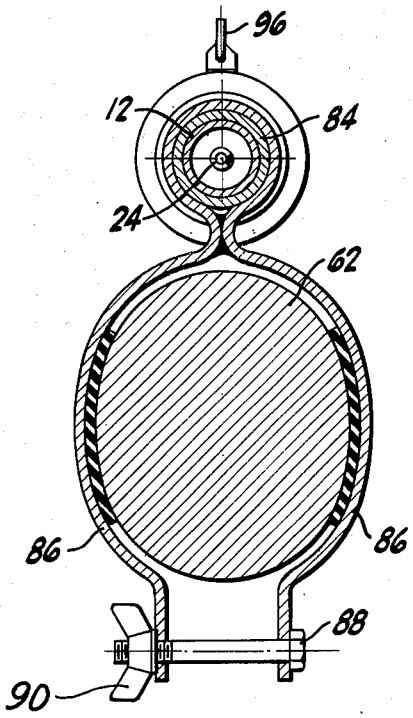
FIG. 4 is a view taken along line 4—4 of FIG. 1

Adaptor 82 mounts member 12, collar 18, and cable 24 to rotating means 30, specifically rotational motion source 62. Adapter 82 includes tube 84, legs 86 and fastener 88, FIGS. 1 and 4. Wing nut 90 permits rapid mounting and removal of adaptor 82.

The cable 24 enters a sheath 92 after leaving member 12. Bushing 94 held to tube 84 by set screw 96, holds sheath at contact area 98. Sheath 92 protects the cable 24 during its rotation, sheath 92 being of large enough size to allow rotation of cable 24.

Figure 6:
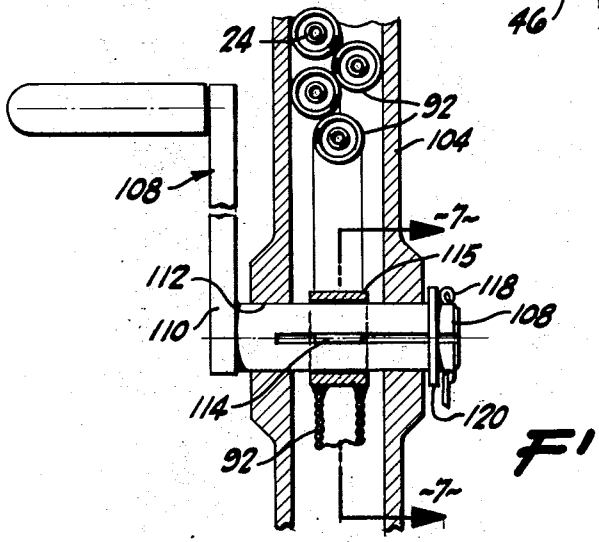
FIG. 6 is a view taken along line 6—6 of FIG. 5
Figure 7:
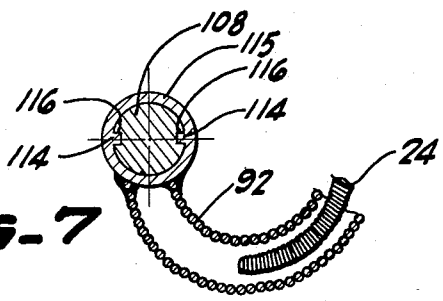
FIG. 7 is a view taken along line 7—7 of FIG. 6

A detachable reel structure 100 includes an arm 102 having a cross arm 104. Flared portion 106 of arm 102 accepts set screw 96 which holds reel structure to adaptor 82, FIGS. 1 and 5. Handle structure 108 may take the form shown in FIG. 6 where handle 110 (broken lined) fits within reel opening 112 via a tongue 114 on ring 115 and groove 116 structure, FIG. 7. Cotter pin 118 and washer 120 aid in the retention of handle 110 within opening 112. Sheath 92 fastens to ring 115 by gluing, welding and any other means known in the art. Cable 24 is free to move within sheath 92, FIG. 7 as is the case with member 12, heretofore described.

Figure 8:
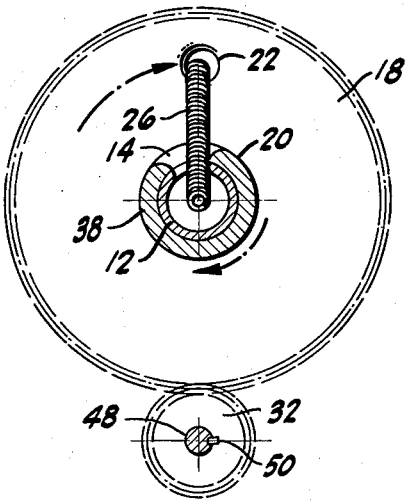
FIG. 8 is a sectionl view showing the dynamics of the invention.
Figure 9:
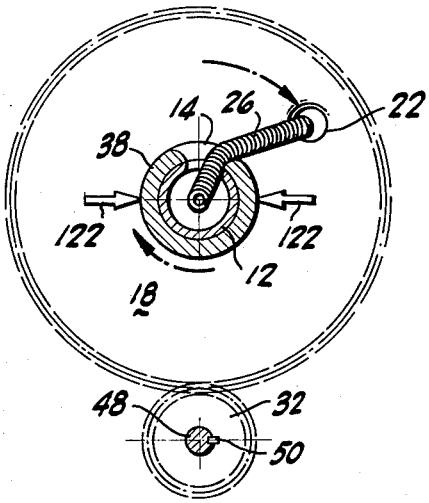
FIG. 9 is a sectional view showing the dynamics of the invention with application of restraining force, shown by arrows.

In operation the user mounts the invention 10 on rotational motion source 62 by inserting shaft 48 into key 50 within center opening 52 of driving wheel 32 and effecting fastener 88 between legs 86. Cable 24 is pulled from member 12 and sheath 92 to increase the distance between cable end portion 28 and the end of the member 12 as desired. Rotational motion source 62 activates causing driving wheel 32 to turn collar 18. Cable 24 will not rotate in this mode of operation although exterior cable portion 26 revolves about the center of first opening 20, FIG. 8. The user activates restraining means 64 which retards the rotation of member 12, depicted in FIG. 9 by arrows 122. Cable portion 26 bears on the sides of openings 14 and 16 and second opening 22. This frictional contact causes the cable portion 26 to rotate, thus rotating the entire cable 24. Release of restraining means 64 results in the cessation of the rotation of cable 24. The distance of cable 24 from member 12 may be increased or decreased as desired.

When cable rotator 10 is to be employed in tight working areas reel structure 100 may be detached by removing set screw 96, and withdrawing flared portion 106. Set screw 96 is inserted to hold bushing 94 and the end of sheath 92. Thus, sheath 92 protects cable 24 when reel structure 100 is removed. It should be noted that the free end of cable 24 within sheath 92 moves in and out within sheath 92 as well as rotating with sheath 92. Handle mechanism 108 reels-up sheath 92 and reel structure 100 reattaches to adaptor 82 in reverse of the detachment procedure explained herebefore.

While in the foregoing specification embodiments of the invention have been set forth in considerable detail for purposes of making a complete disclosure of the invention, it will be apparent to those skilled in the art that numerous changes may be made in such details without departing from the spirit and principles of the invention.

What is claimed is:

1. A cable rotator comprising:

a. hollow member having a pair of spaced openings disposed in the wall thereof;

b. a collar providing a first and second opening therethrough, said hollow member passing through said collar's first opening and selectively grippingly engaging and slippingly engaging the sides of said collar's first opening, the cable passing through the interior of said hollow member with a portion of the cable disposed to the exterior of said hollow member through said pair of spaced openings, said exterior cable portion passing through said second opening in said collar;

c. rotating means for rotating said collar.

2. The cable rotator of claim 1 in which said collar is a first wheel and said rotating means includes a second wheel, the periphery of said first and second wheels frictionally engaging one another such that rotation of said second wheel rotates said first wheel.

3. The cable rotator of claim 2 which additionally comprises restraining means for restraining rotation of said hollow elongated member relative to rotation of said first wheel.

4. The cable rotator of claim 3 in which said restraining means includes a drum circumjacently affixed to a portion of said elongated hollow member, an open end positioned about the exterior of said drums, and means for tightening said band about the exterior of said drum.

5. The cable rotator of claim 1 which additionally comprises a sheath enclosing an end of the cable which is freely rotatable therewithin.

6. The cable rotator of claim 5 in which said collar is a first wheel and said rotating means includes a second wheel, the periphery of said first and second wheels frictionally engaging one another such that rotation of said second wheel rotates said first wheel.

7. The cable rotator of claim 6 which additionally comprises restraining means for restraining rotation of said hollow elongated member relative to rotation of said first wheel.

8. The cable rotator of claim 7 in which said restraining means include a drum circumjacently affixed to a portion of said elongated hollow member, an open end positioned about the exterior of said drums, and means for tightening said band about the exterior of said drum.

9. The cable rotator of claim 8 which additionally comprises a housing enclosing collar and the cable position exterior to said hollow member and comprises a reel structure for coiling said sheath and an end of the cable therein.

10. The cable rotator of claim 9 which additionally includes an adaptor for mounting said hollow elongated member, said collar, and the cable to said means for rotating said collar.

* * * * *